US010475602B2

(12) United States Patent
Kim

(10) Patent No.: US 10,475,602 B2
(45) Date of Patent: Nov. 12, 2019

(54) KEY COUPLING UNIT AND ELECTRONIC DEVICE HAVING THE SAME

(71) Applicant: Samsung Electronics Co., Ltd, Gyeonggi-do (KR)

(72) Inventor: Kyungpil Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 31 days.

(21) Appl. No.: 15/610,248

(22) Filed: May 31, 2017

(65) Prior Publication Data

US 2017/0372854 A1 Dec. 28, 2017

(30) Foreign Application Priority Data

Jun. 24, 2016 (KR) ..... 10-2016-0079568

(51) Int. Cl.
*H01H 13/14* (2006.01)
*H01H 13/50* (2006.01)
*H01H 13/06* (2006.01)

(52) U.S. Cl.
CPC ..... *H01H 13/14* (2013.01); *H01H 13/06* (2013.01); *H01H 13/50* (2013.01); *H01H 2221/06* (2013.01)

(58) Field of Classification Search
CPC .... H01H 13/06; H01H 2223/002; H01H 9/04; H01H 13/86; H01H 2009/048; H01H 13/063; H01H 21/08; H01H 2013/066; H01H 13/14; H01H 3/125; H01H 13/704; H01H 13/04; H01H 2221/044; H01H 13/20; H01H 3/12; H01H 13/02; H01H 13/703
USPC ..... 200/5 A, 314, 341–345, 302.1, 302.2
See application file for complete search history.

(56) References Cited

U.S. PATENT DOCUMENTS 6,635,838 B1 * 10/2003 Kornelson ..... H01H 9/041 200/302.2
2007/0034493 A1 * 2/2007 Kawasaki ..... H01H 13/86 200/302.2
2011/0226599 A1 * 9/2011 Xiao ..... H04M 1/236 200/341

FOREIGN PATENT DOCUMENTS

KR 20140026106 A 3/2014

* cited by examiner

*Primary Examiner* — Ahmed M Saeed

(57) ABSTRACT

An electronic device and a key coupling unit therefor are disclosed. The key coupling unit includes a key configured in a specific shape, a key guide frame configured to guide pressing of the key, and a key circuit board configured to input a signal corresponding to the pressing of the key. The key coupling unit is fixed in a settling area of a bracket. A bumper is formed to protrude from the lower part of the key circuit board. A pressing part is formed in the bracket to face the bumper of the key circuit board. A command signal of a corresponding key is transmitted to the key circuit board by converting to an electric signal if the bumper presses the pressing part. The bumper and the pressing part are located by moving in a lateral direction from the center of the settling area of the bracket.

16 Claims, 10 Drawing Sheets

KEY COUPLING UNIT AND ELECTRONIC DEVICE HAVING THE SAME

CROSS-REFERENCE TO RELATED APPLICATION(S) AND CLAIM OF PRIORITY

The present application is related to and claims the benefit under 35 U.S.C. § 119(a) of a Korean patent application filed on Jun. 24, 2016, in the Korean Intellectual Property Office and assigned Ser. No. 10-2016-0079568, the entire disclosure of which is hereby incorporated by reference.

TECHNICAL FIELD

Various embodiments of the present invention relate to an electronic device and, more particularly, to a configuration of mobile equipment that can solve problems of key jamming or sticking due to a thin window of the mobile equipment and problems of key inclining if an end of a key is pressed.

BACKGROUND

As is already well known, electronic devices, such as a mobile communication terminal (smartphone), electronic organizer, personal digital assistant, television (TV), and laptop computer, have become important and necessary means for transmitting information that changes rapidly in modern society.

A trend with such electronic devices is the realizing of miniaturization, slimness, high grip property, and light weight in consideration of transportability by a user, and various accessories are being introduced in accordance with the trend.

As the result, mobile electronic devices now provide convenience in user operations through a graphical user interface (GUI) environment and various multimedia based on a web environment by satisfying demands for miniaturization, light weight, multi-function, and multi-purpose.

In addition, structures of the mobile electronic devices are developing to provide a high data communication function as well as a voice communication function. Accordingly services using a wireless communication technology can be provided for transmitting data at a high speed to respond to the increasing requirements of consumers.

Accordingly, general mobile electronic devices have to be equipped with a data input/output device, speaker, microphone, and antenna. In mobile electronic devices, such as a recent smartphone, a virtual keyboard displayed in a touch screen is used as a data input device, a keypad assembly configured with a plurality of keys is omitted, and only one key is provided as a practical data input device. However, in most mobile electronic devices, desired data is still input through the operation of pressing a plurality of keys such as a home key.

SUMMARY

In a general key coupling unit, a key is fixed to a bracket by coupling a hole formed at an edge of the key and a hole formed at the bracket with a screw or by inserting the edge of the key through the hole formed at the bracket and bending the edge of the key from the upper surface to the rear surface of the bracket.

Further, an upper part in a dome shape is located at the center of the key, and if an edge of the up, down, left, or right side of the key is pressed, the key operates by inclining towards a side.

Accordingly, if a guiding amount of an outer side of the key becomes small because of a reduced window thickness, the key inclines to a side from the pressing of an edge of the key, and thereby problems can arise because the outer side of the key jams or sticks to a window or a decoration part.

To address the above-discussed deficiencies, it is a primary object to provide a key coupling unit and an electronic device having the same that can prevent a key jamming or sticking problem by extending a lower side length of a key guide frame and maximize a stabilizing effect of the key.

A key coupling unit according to an embodiment of the present invention may comprise a key configured in a specific shape, a key guide frame configured to guide pressing of the key, and a key circuit board configured to input a signal corresponding to the pressing of the key. The key coupling unit can be fixed in a settling area of a bracket, a bumper may be formed to protrude from the lower part of the key circuit board, a pressing part may be formed in the bracket to face the bumper of the key circuit board, a command signal of a corresponding key can be transmitted to the key circuit board by converting to an electric signal if the bumper presses the pressing part, and the bumper and the pressing part may be located by moving in a lateral direction from the center of the settling area of the bracket.

An electronic device according to another embodiment of the present invention may comprise a key coupling unit including a key configured in a specific shape, a key guide frame configured to guide pressing of the key, and a key circuit board configured to input a signal corresponding to the pressing of the key; a bracket having a settling area for fixing the key coupling unit; and a window configured to support a key guide frame of the key coupling unit and to expose the key guide frame through an opening. A bumper may be formed to protrude from the lower part of the key circuit board, a pressing part may be formed in the bracket to face the bumper of the key circuit board, a command signal of a corresponding key can be transmitted to the key circuit board by converting to an electric signal if the bumper presses the pressing part, and the bumper and the pressing part may be located by moving in a lateral direction from the center of the settling area of the bracket.

The key may be configured so that the slope of the key decreases if the key is pressed in any direction by the movement of the bumper and the pressing part.

The settling area of the bracket may be recessed in a predetermined depth so that the upper surface of the key becomes almost parallel to an upper surface of a window.

The key circuit board may be a fingerprint recognition flexible printed circuit board (FPCB).

The key guide frame may further comprise a pair of support frames which protrude at both ends of the key guide frame.

A part of the key circuit board may be exposed between the support frames.

The bumper of the key circuit board can extend in a direction opposite to the protruding direction of the support frames.

The distance from the center of the bumper of the key circuit board to an end of the support frame and the distance from the center of the bumper of the key circuit board to the other end of the key guide frame may have a difference as much as an extruded length of the support frame.

The key coupling unit may be disposed between the window and the bracket, and configured in a structure of which electric parts of a main circuit board for an electric drive of the electronic device are closed of the window at the rear surface of the bracket.

The key coupling unit may further comprise a pair of support plates disposed at the upper and lower parts of the key guide frame and a plurality of waterproofing tapes attached between the support plates.

The support plate can be fixed in the settling area of the bracket and exposed through the opening of the window. One of the waterproofing tapes may be attached between the upper part of the support plate and the key coupling unit and the other one may be attached between the lower part of the support plate and the key coupling unit.

The window may further comprise an additional member which is used as a decoration member.

According to various embodiments of the present invention, a support frame is formed by extending a lower side of a key guide frame, problems of key jamming or sticking generated by a slim window can be solved because a location of a dome moves in a direction facing to the direction of the support frame, and a stabilizing effect can be obtained by reducing the slope of the key even though the key is pressed in any direction of the up, down, left, or right sides, i.e., any direction of a lengthwise direction or a widthwise direction.

According to various embodiments of the present invention, internal electric components of a mobile electronic device can be protected by blocking a liquid or gas flowing from the outside because a key guide frame is fixed by a support plate at the upper and lower sides of the key guide frame and waterproofing tapes are disposed between the key guide frame and the support plate.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
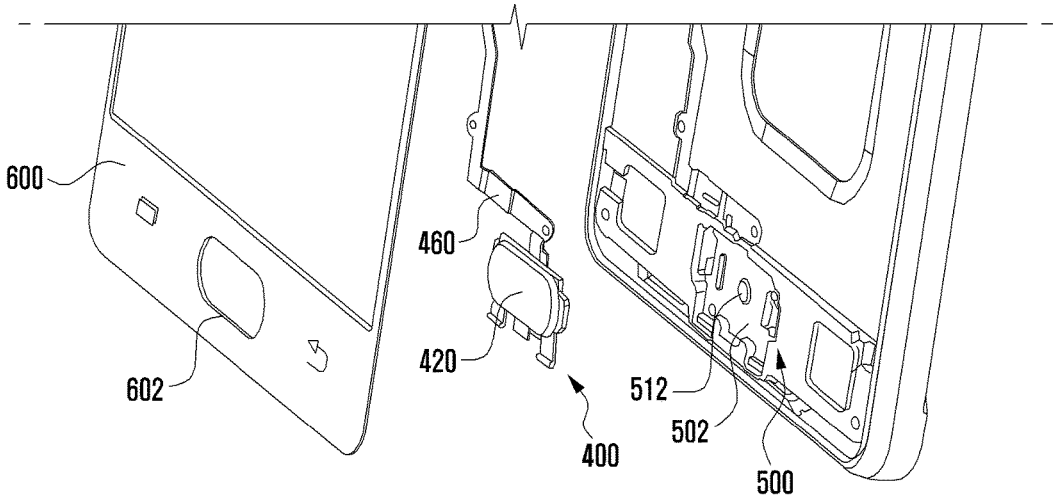
FIG. 1 is an exploded perspective view illustrating an electronic device having a key coupling unit according to various embodiments of the present invention.

FIGS. 1 through 10, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged electronic device.

The expressions such as "include" and "may include" which may be used in the present disclosure denote the presence of the disclosed functions, operations, and constituent elements and do not limit one or more additional functions, operations, and constituent elements. In the present disclosure, the terms such as "include" and/or "have" may be construed to denote a certain characteristic, number, step, operation, constituent element, component or a combination thereof, but may not be construed to exclude the existence of or a possibility of addition of one or more other characteristics, numbers, steps, operations, constituent elements, components or combinations thereof.

Furthermore, in the present disclosure, the expression "and/or" includes any and all combinations of the associated listed words. For example, the expression "A and/or B" may include A, may include B, or may include both A and B.

In the present disclosure, expressions including ordinal numbers, such as "first" and "second," etc., may modify various elements. However, such elements are not limited by the above expressions. For example, the above expressions do not limit the sequence and/or importance of the elements. The above expressions are used merely for the purpose to distinguish an element from the other elements. For example, a first user device and a second user device indicate different user devices although both of them are user devices. For example, a first element could be termed a second element, and similarly, a second element could be also termed a first element without departing from the scope of the present disclosure.

In the case where a component is referred to as being "connected" or "accessed" to other component, it should be understood that not only the component is directly connected or accessed to the other component, but also there may exist another component between them. Meanwhile, in the case where a component is referred to as being "directly connected" or "directly accessed" to other component, it should be understood that there is no component therebetween. The terms used in the present disclosure are only used to describe specific various embodiments, and are not intended to limit the present disclosure. As used herein, the singular forms are intended to include the plural forms as well, unless the context clearly indicates otherwise. Singular forms are intended to include plural forms unless the context clearly indicates otherwise.

An electronic device according to the present disclosure may be a device including a communication function. For example, the device corresponds to a combination of at least one of a smartphone, a tablet Personal Computer (PC), a mobile phone, a video phone , an e-book reader, a desktop PC, a laptop PC, a netbook computer, a Personal Digital Assistant (PDA), a Portable Multimedia Player (PMP), digital audio player, a mobile medical device, an electronic bracelet, an electronic necklace, an electronic accessory, a camera, a wearable device, an electronic clock, a wrist watch, home appliances (for example, an air-conditioner, vacuum, an oven, a microwave, a washing machine, an air cleaner, and the like), an artificial intelligence robot, a Television (TV), a Digital Video Disk (DVD) player, an audio device, various medical devices (for example, Magnetic Resonance Angiography (MRA), Magnetic Resonance Imaging (MRI), Computed Tomography (CT), a scanning machine, a ultrasonic wave device, or the like), a navigation device, a Global Positioning System (GPS) receiver, an Event Data Recorder (EDR), a Flight Data Recorder (FDR), a set-top box, a TV box (for example, Samsung HomeSync™, Apple TV™, or Google TV™), an electronic dictionary, vehicle infotainment device, an electronic equipment for a ship (for example, navigation equipment for a ship, gyrocompass, or the like), avionics, a security device, electronic clothes, an electronic key, a camcorder, game consoles, a Head-Mounted Display (HMD), a flat panel display device, an electronic frame, an electronic album, furniture or a portion of a building/structure that includes a communication function, an electronic board, an electronic signature receiving device, a projector, and the like. It is obvious to those skilled in the art that the electronic device according to the present disclosure is not limited to the aforementioned devices.

Figure 2:
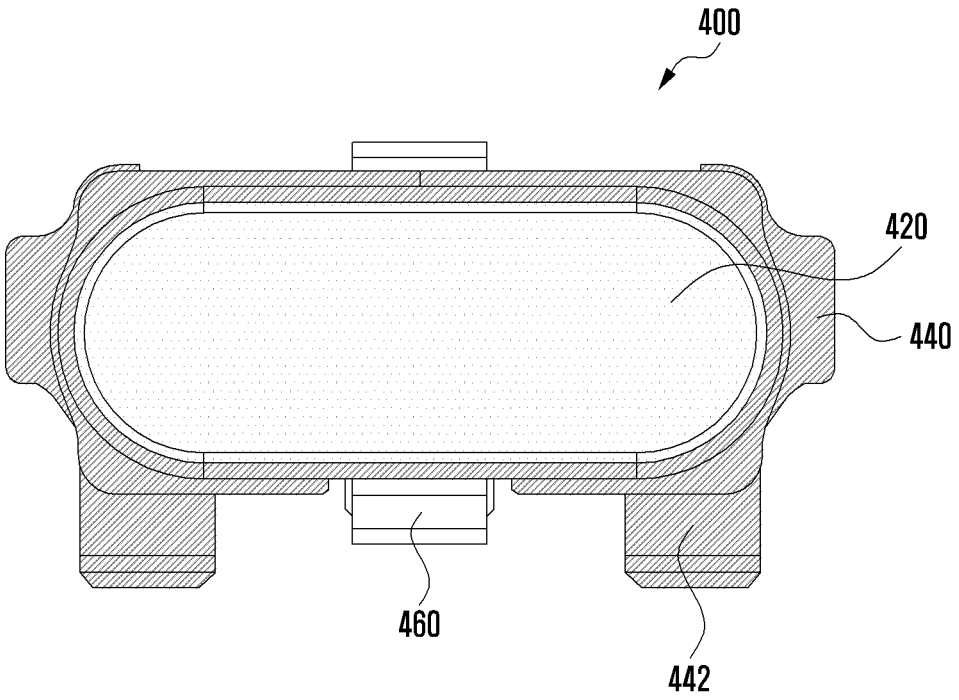
FIG. 2 is a plan view illustrating a coupling state of the key coupling unit of FIG. 1.
Figure 3:
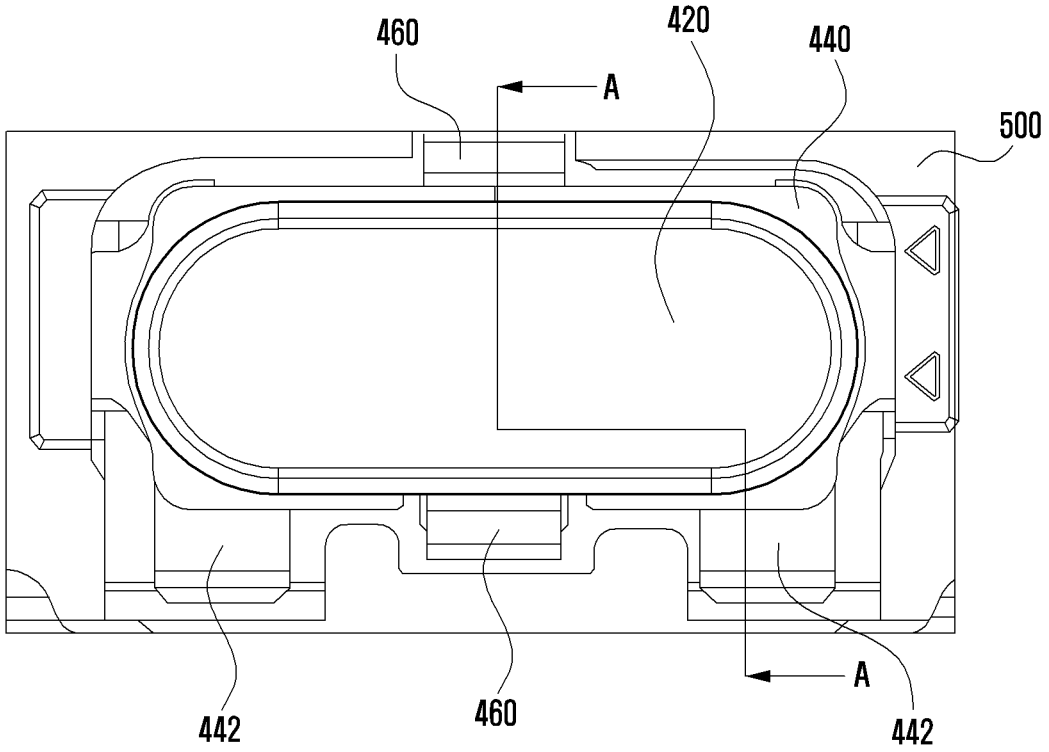
FIG. 3 is a plan view illustrating a state of an electronic device coupled with the key coupling unit of FIG. 1.
Figure 4:
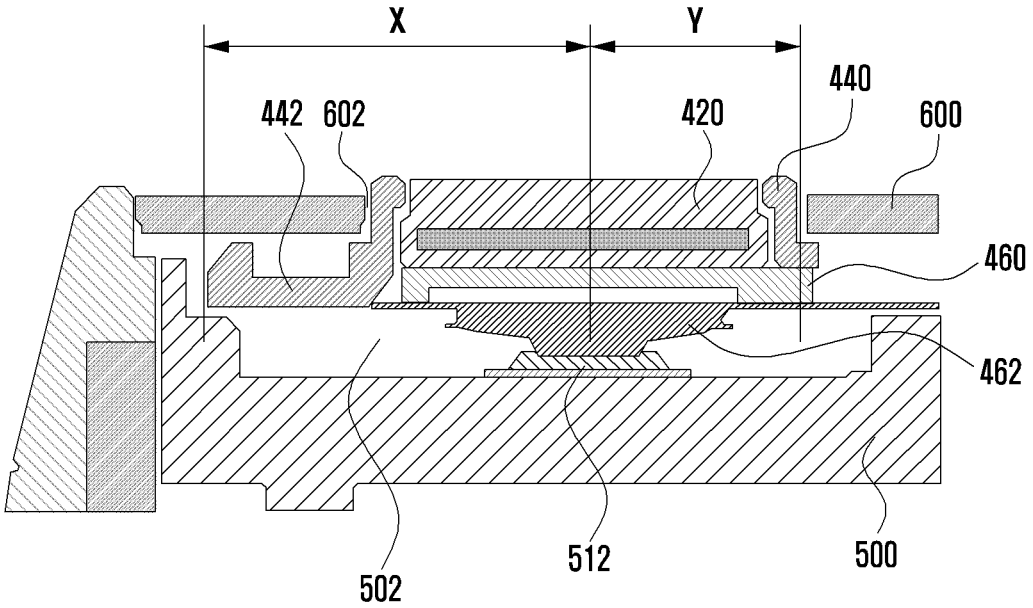
FIG. 4 illustrates a cross-sectional view formed by cutting along the line A-A of FIG. 3.

FIG. 1 is an exploded perspective view illustrating an electronic device having a key coupling unit according to various embodiments of the present invention; FIG. 2 is a plan view illustrating a coupling state of the key coupling unit of FIG. 1; FIG. 3 is a plan view illustrating a state of an electronic device coupled with the key coupling unit of FIG. 1; and FIG. 4 illustrates a cross-sectional view formed by cutting along the line A-A of FIG. 3.

Hereinafter, FIGS. 1 to 4 illustrate a portion of the electronic device that is equipped with a key coupling unit 400 including a key 420, key guide frame 440, and key circuit board 460; a bracket 500; a window 600; and a main circuit board (not shown); however, it will be apparent to those skilled in the art that the key coupling unit 400 according to various embodiments of the present invention can be modified in various forms and installed at any location of the electronic device With reference to FIGS. 1 to 4, the key coupling unit 400 of the electronic device according to various embodiments of the present invention is settled in the bracket 500 supporting the lower side of the key guide frame 440 and can be exposed though an opening 602 of the window 600 supporting the upper side of the key guide frame 440. The window 600 may include a decoration member.

The bracket 500 may have a settling area 502 recessed in a predetermined depth for fixing the key coupling unit 400, and the settling area 502 may be recessed in an enough depth so that the upper surface of the key 420 of the key coupling unit 400 becomes almost or is substantially parallel to the upper surface of the window 600.

According to an embodiment of the present invention, the key coupling unit 400 may include a key 420 formed in an elliptical shape and located in the key coupling unit 400, a key guide frame 440 formed to guide pressing of the key 420, and a key circuit board 460 for inputting a command signal corresponding to the key pressing.

A bumper 462 protruding downwards may be formed in a dome shape at the lower part of the key circuit board 460, and a pressing part 512 protruding upwards corresponding to a bumper 462 of the key circuit board 460 may be formed in a dome shape in the settling area 502 of the bracket 500.

For example, if the key 420 is pressed, the bumper 462 presses the pressing part 512 and a command signal corresponding to the pressing of the key 420 can be converted to an electric signal and transmitted to a circuit formed on the key circuit board 460. The command signal transmitted to the circuit of the key circuit board 460 can be transmitted to a main circuit board connected electrically to the key circuit board 460.

According to various embodiments of the present invention, the bumper 462 of the key circuit board 460 and the pressing part 512 of the bracket 500 facing the bumper 462 can be located by being offset or displaced laterally from the center of the settling area 502 of the bracket 500.

The bumper 462 of the key circuit board 460 and the pressing part 512 of the bracket 500 may be formed with an elastic material such as rubber or silicon so as to be deformed elastically if a user's finger presses the upper surface of the key 420 and to be restored if the user's finger is released. Like this, a command signal input by a user can be transmitted to the key circuit board 460 by operating the bumper 462 and the pressing part 512 corresponding to the key pressing.

Accordingly the key coupling unit 400 is disposed between the lower part of the opening 602 of the window 600 and the upper surface of the bracket 500, and electric components such as a main circuit board (not shown) and a USB port installed for a drive of the electronic device can be disposed at the rear surface of the bracket 500. Accordingly, the electric components such as a main circuit board installed at the rear surface of the bracket 500 can be closed off from the opening 602 of the window 600.

The key circuit board 460 may be a flexible printed circuit board (FPCB) or a general printed circuit board (PCB) of a hard type. A plurality of circuits and microchips can be installed on the upper surface of the key circuit board 460, and the rear surface of the key circuit board 460 can be combined closely with the upper surface of the bracket 500.

According to various embodiments of the present invention, the key circuit board 460 can be fixed with an adhesive material such as a tape or glue, or combined by using an assembly unit such as a hook and a hook hole.

According to various embodiments of the present invention, support frames 442 may be provided. For example, a pair of support frames 442 may extend by protruding from respective ends located at a side of the key guide frame 440, e.g., both ends located at the lower side in FIG. 2. Here, a part of the key circuit board 460 can be exposed between the pair of support frames 442, and may be formed with a fingerprint recognition FPCB.

Figure 5:
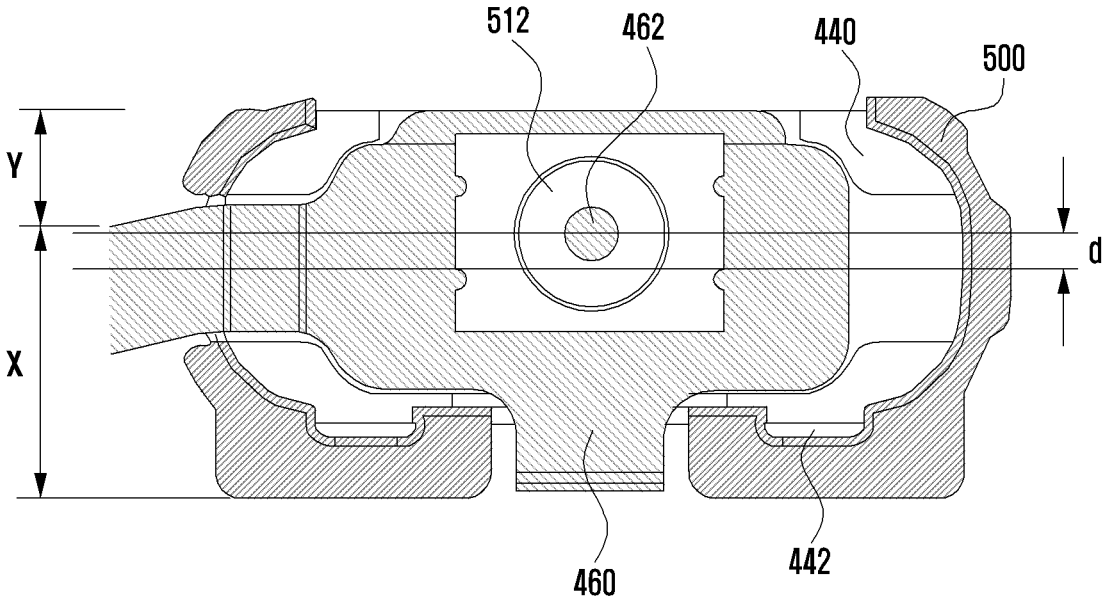
FIG. 5 is a plan view illustrating the key coupling unit of FIG. 4.

With reference to FIG. 5 in which the key 420 of FIG. 4 is omitted, the key coupling unit 400 according to various embodiments of the present invention may be configured so that the bumper 462 of the key circuit board 460 and the pressing part 512 of the bracket 500 protruding upwards corresponding to the bumper 462 can move laterally from the center of the settling area 502 of the bracket 500.

The support frame 442 of the key guide frame 440 can protrude from both ends located at a side of the key guide frame 440 as shown in FIG. 4. Accordingly, the distance from the center of the bumper 462 of the key circuit board 460 to an end of the support frame 442 becomes X, the distance from the center of the bumper 462 of the key circuit board 460 to the other end of the key guide frame 440 becomes Y, and thereby the distance X becomes different from the distance Y. Namely, the distance X becomes longer than the distance Y as much as the length of a protruding part of the support frame 442, and the pressing part 512 of the bracket 500 formed corresponding to the bumper 462 of the key circuit board 460 can move from the center of the settling area 502 of the bracket 500 to a side, especially in a direction facing the direction of support frame 442 protruding from the key guide frame 440.

According to an embodiment of the present invention, the support frame 442 of the guide frame 440 protrudes downwards as shown in FIG. 5, and the pressing part 512 of the bracket 500 formed corresponding to the bumper 462 of the key circuit board 460 can be spaced apart as much as a distance d from the center of the settling area 502 of the bracket 500.

Although not shown in the drawings, according to an embodiment of the present invention, the support frame 442 of the guide frame 440 may protrude to the right or left side, and the pressing part 512 of the bracket 500 formed corresponding to the bumper 462 of the key circuit board 460 can move in a direction facing the protruding direction of the support frame 442.

Figure 6:
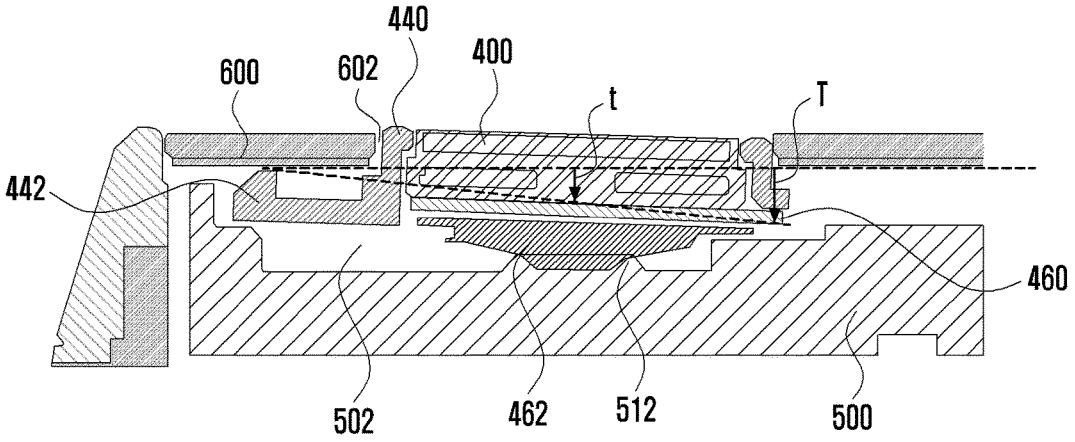
FIG. 6 is a cross-sectional view illustrating a key jamming protection function of a key coupling unit according to various embodiments of the present invention.

Hereinafter, operations of the key coupling unit of the electronic device configured according to various embodiments of the present invention will be described with reference to FIG. 6.

If the key 420 is pressed, the bumper 462 presses the pressing part 512, and a command signal corresponding to the pressed key 420 can be transmitted to a circuit formed on the key circuit board 460 by converting to an electric signal. Because the pressing part 512 of the bracket 500 formed corresponding to the bumper 462 of the key circuit board 460 is displaced as much as a predetermined distance from the center of the settling area 502 of the bracket 500, a hinge for pressing the key 420 does not move to a side of the key guide frame 440 as in a conventional method, but the support frame 442 protruded from both ends located at a side of the key guide frame 440 extends. Accordingly, an operating stroke t according to the present invention is shorter in length than a conventional operating stroke T.

According to the reduced operating stroke of the key 420, a stabilizing effect of the key 420 can be obtained even though any of the up, down, left, or right parts of the key 420 are pressed and the other side of the key 420 facing the support frame 442 is prevented from jamming in the window 600; thereby, problems of key jamming or sticking according to a slim window can be solved.

Figure 7:
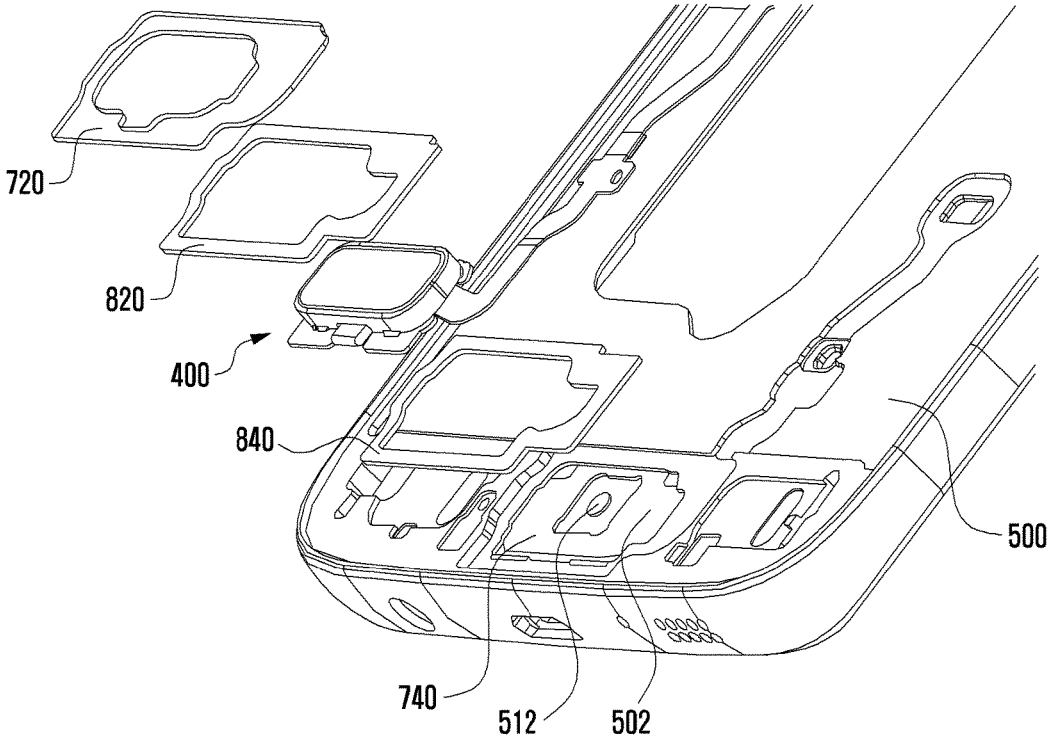
FIG. 7 is an exploded perspective view illustrating a key coupling unit of an electronic device according to various embodiments of the present invention.
Figure 8:
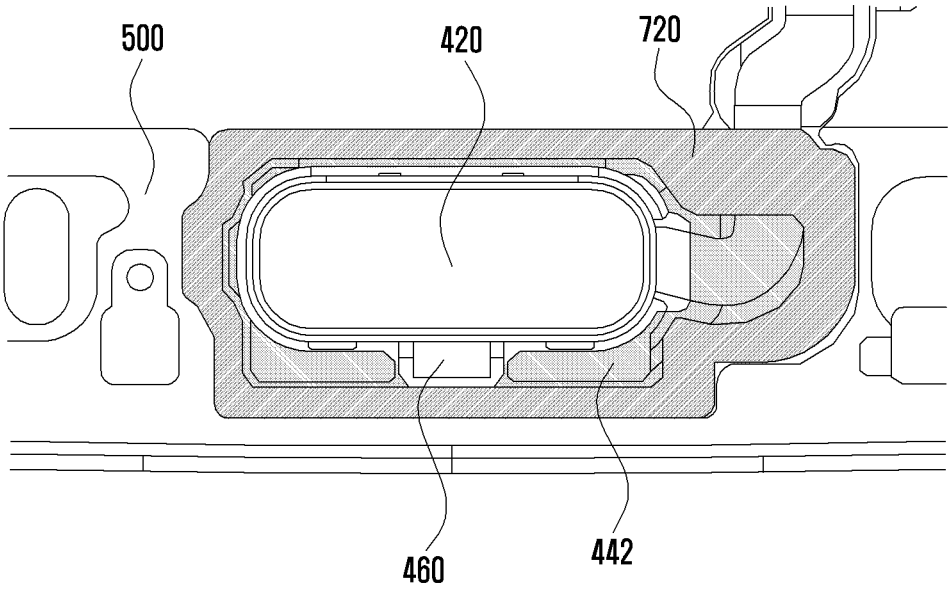
FIG. 8 illustrates an assembled state of the key coupling unit of FIG. 7.

FIG. 7 is an exploded perspective view illustrating a key coupling unit of an electronic device according to various embodiments of the present invention; FIG. 8 illustrates an assembled state of the key coupling unit of FIG. 7; and FIG. 9 is a plan view illustrating the key coupling unit of FIG. 8.

Figure 9:
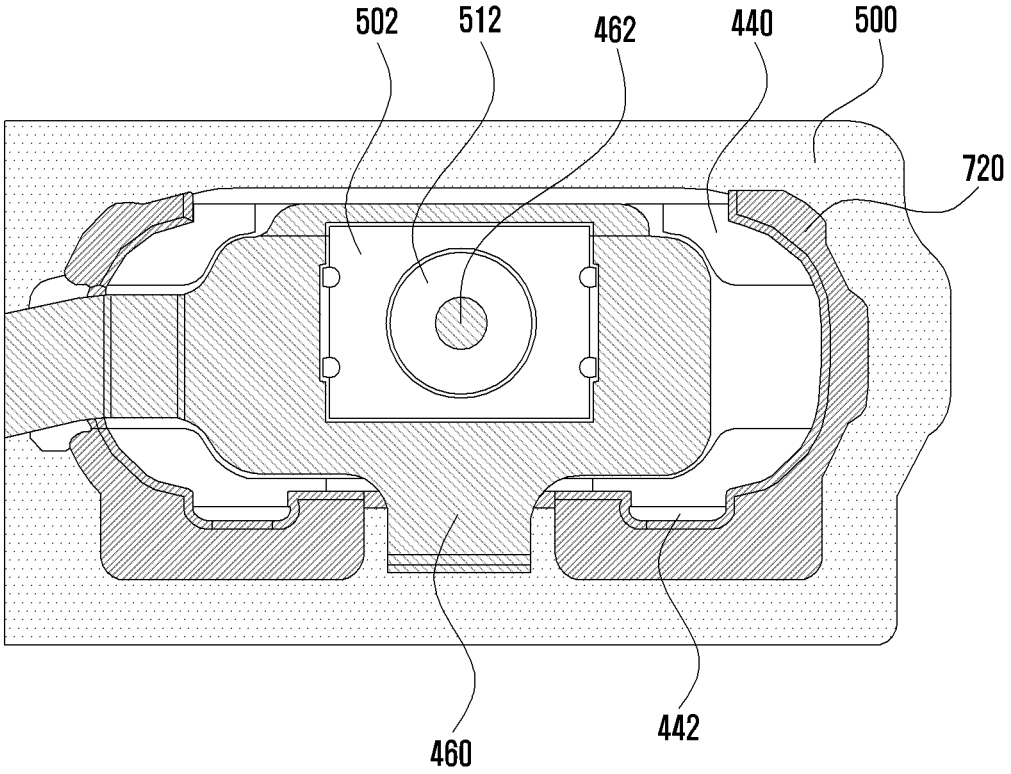
FIG. 9 is a plan view illustrating the key coupling unit of FIG. 8.

With reference to FIGS. 7 to 9 in which the window is omitted, fingerprint recognition and waterproof functions can be applied to the key coupling unit 400 of the electronic device according to various embodiments of the present invention.

The key guide frame 440 of the key coupling unit 400 in FIG. 7 can be located in the settling area 502 of the bracket 500 and exposed through a window (omitted in the drawings) by disposing a pair of support plates 720 and 740 at the upper and lower parts of the key guide frame 440. The window may include a decoration member as already illustrated in FIGS. 1 to 6.

A plurality of waterproofing tapes 820 and 840 can be attached between an upper support plate 720, a lower support plate 740, and the key coupling unit 400. According to an embodiment of the present invention, the first waterproofing tape 820 can be attached between the upper support plate 720 and the key coupling unit 400, and the second waterproofing tape 840 can be attached between the lower support plate 740 and the key coupling unit 400.

As illustrated in the embodiments of FIGS. 1 to 6, the bracket 500 may have a settling area 502 recessed in a predetermined depth so that the key coupling unit 400 can be fixed, and the settling area 502 can be recessed in an enough depth so that the upper surface of the key 420 of the key coupling unit 400 becomes almost parallel to the upper surface of the window.

According to an embodiment of the present invention, the key coupling unit 400 may include a key 420 internally formed in an elliptical shape, a key guide frame 440 formed to guide pressing of the key 420, and a key circuit board 460 configured to input a command signal corresponding to the pressing of the key 420.

A bumper 462 protruding downwards can be formed in a dome shape at the lower part of the key circuit board 460, and a pressing part 512 protruding upwards corresponding to the bumper 462 of the key circuit board 460 can be formed in the settling area 502 of the bracket 500.

For example, if the key 420 is pressed, the bumper 462 presses the pressing part 512 and a command signal corresponding to the pressing of the key 420 can be converted to an electric signal and transmitted to a circuit formed on the key circuit board 460. The command signal transmitted to the circuit of the key circuit board 460 can be transmitted to a main circuit board connected electrically to the key circuit board 460.

The bumper 462 of the key circuit board 460 and the pressing part 512 of the bracket 500 may be formed with an elastic material such as rubber or silicon so as to be deformed elastically if a user's finger presses the upper surface of the key 420 and to be restored if the user's finger is released. Like this, a command signal input by a user can be transmitted to the key circuit board 460 by operating the bumper 462 and the pressing part 512 corresponding to the key pressing.

Accordingly the key coupling unit 400 is disposed between the lower part of the opening 602 of the window 600 and the upper surface of the bracket 500, and electric components such as a main circuit board (not shown) and a USB port installed for a drive of the electronic device can be disposed at the rear surface of the bracket 500. Accordingly, the electric components such as a main circuit board installed at the rear surface of the bracket 500 can be closed off the opening 602 of the window 600.

The key circuit board 460 may be a FPCB or a general PCB of a hard type. A plurality of circuits and microchips can be installed on the upper surface of the key circuit board 460, and the rear surface of the key circuit board 460 can be combined closely with the upper surface of the bracket 500.

According to various embodiments of the present invention, the key circuit board 460 can be fixed with an adhesive material such as a tape or glue, or combined by using an assembly unit such as a hook and a hook hole.

According to various embodiments of the present invention, a pair of support frames 442 can be extended by protruding from both ends located at a side of the key guide frame 440, and a key circuit board 460 configured with a fingerprint recognition FPCB can be exposed between the pair of support frames 442.

Further, the support frame 442 of the key guide frame 440 protrudes from both ends located at a side of the key guide frame 440, and thereby the distance from the center of the bumper 462 of the key circuit board 460 to an end of the support frame 442 and the distance from the center of the bumper 462 of the key circuit board 460 to the other end of the key guide frame 440 become different. Accordingly according to the support frame 442 extended as much as a protruding length, the pressing part 512 of the bracket 500 formed corresponding to the bumper 462 of the key circuit board 460 can move from the center of the settling area 502 of the bracket 500 to a side, especially in a direction facing the direction of support frame 442 protruding from the key guide frame 440.

Figure 10:
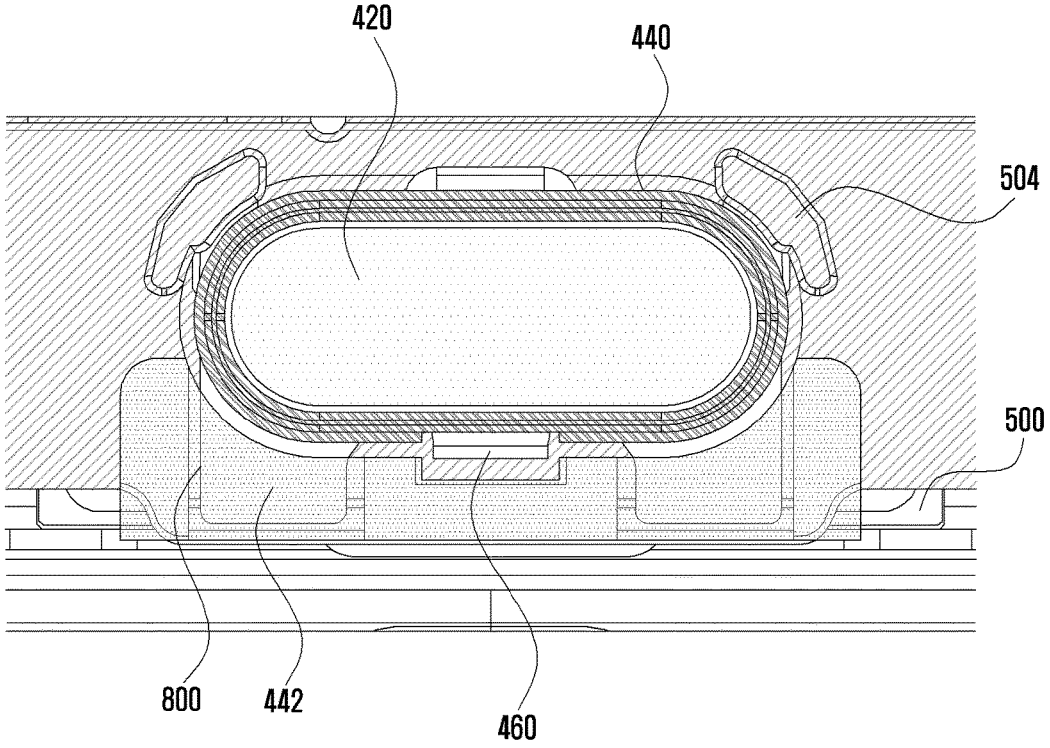
FIG. 10 is a schematic plan view illustrating a state of which a support frame of a key coupling unit is assembled into a bracket according to various embodiments of the present invention.

FIG. 10 is a schematic plan view illustrating a state of which a support frame of a key coupling unit is assembled into a bracket according to various embodiments of the present invention.

With reference to FIG. 10, the support frame 442 of the key coupling unit 400 according to various embodiments of the present invention can be extended by protruding towards both ends located at a side of the key guide frame 440, and a window attaching space can be secured by using an additional member 800 as a decoration member for the window.

In the meantime, a poor click sense can be generated because the operation of the key 420 becomes unstable in a state that the window is raised. The key coupling unit 400 according to various embodiments of the present invention can minimize the poor click sense by maintaining a stable key operation, even though the key 420 is pressed in a state that the window is raised, because both ends located at the other side of the key guide frame 440 are locked by a locking part 460 of the bracket 500 as soon as the bracket 500 of the key guide frame 440 is engaged into the settling space 502.

As described above, according to various embodiments of the present invention, a support frame is formed by extending a lower side of a key guide frame, problems of key jamming or sticking generated by a slim window can be solved because a location of a dome moves in a direction facing to the direction of the support frame, and a stabilizing effect can be obtained by reducing the slope of the key even though the key is pressed in directions such as up, down, left, or right sides, i.e., any direction of a lengthwise direction or a widthwise direction.

Further, according to various embodiments of the present invention, internal electric components of a mobile electronic device can be protected by blocking a liquid or gas flowing from the outside because a key guide frame is fixed by a support plate at the upper and lower sides of the key guide frame and waterproofing tapes are disposed between the key guide frame and the support plate.

Various embodiments of the present invention have been disclosed with reference to the accompanying drawings as specific examples for easier understanding of the technical scope of the present invention, but various embodiments are not limited to the specific examples.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A key coupling unit for an electronic device, the key coupling unit comprising:

a key configured in a specific shape;

a key guide frame configured to guide pressing of the key; and a key circuit board configured to input a signal corresponding to the pressing of the key, wherein the key coupling unit is fixed in a settling area of a bracket, the settling area is formed by recessing the bracket along a pressing direction of the key, a bumper is formed to protrude from a lower part of the key circuit board, a pressing part is formed in the bracket to face the bumper, a command signal of a corresponding key is transmitted to the key circuit board by converting to an electric signal if the bumper presses the pressing part, and the bumper and the pressing part are laterally offset from a center of the settling area of the bracket, wherein the key guide frame further comprises a pair of support frames, each of which protrudes from a respective end of the key guide frame, and wherein a first distance from a center of the bumper to an end of one of the support frames and a second distance from the center of the bumper to another end of the key guide frame have a difference as much as an extruded length of the support frames.

2. The key coupling unit of claim 1, wherein the key is configured so that a slope of the key decreases if the key is pressed by movement of the bumper and the pressing part.

3. The key coupling unit of claim 1, wherein the settling area of the bracket is recessed to a predetermined depth so that an upper surface of the key is substantially parallel to an upper surface of a window.

4. The key coupling unit of claim 1, wherein the key circuit board is a fingerprint recognition flexible printed circuit board (FPCB).

5. The key coupling unit of claim 1, wherein a part of the key circuit board is exposed between the support frames.

6. The key coupling unit of claim 1, wherein the bumper of the key circuit board extends in a direction opposite to a protruding direction of the support frames.

7. The key coupling unit of claim 1, wherein the key coupling unit is disposed between a window and the bracket, and configured so that electric parts of a main circuit board for an electric drive of the electronic device are closed off from the window at a rear surface of the bracket.

8. An electronic device comprising:

a key coupling unit including a key configured in a specific shape, a key guide frame configured to guide pressing of the key, and a key circuit board configured to input a signal corresponding to the pressing of the key;

a bracket having a settling area for fixing the key coupling unit; and a window configured to support the key guide frame of the key coupling unit and to expose the key guide frame through an opening, wherein the settling area is formed by recessing the bracket along a pressing direction of the key, wherein a bumper is formed to protrude from a lower part of the key circuit board, a pressing part is formed in the bracket to face the bumper, a command signal of a corresponding key is transmitted to the key circuit board by converting to an electric signal if the bumper presses the pressing part, and the bumper and the pressing part are laterally offset from a center of the settling area of the bracket, wherein the key guide frame further comprises a pair of support frames, each of which protrudes from a respective end of the key guide frame, and wherein a first distance from a center of the bumper to an end of one of the support frames and a second distance from the center of the bumper to another end of the key guide frame have a difference as much as an extruded length of the support frame.

9. The electronic device of claim 8, wherein the key is configured so that a slope of the key decreases if the key is pressed by movement of the bumper and the pressing part.

10. The electronic device of claim 8, wherein the settling area of the bracket is recessed to a predetermined depth so that an upper surface of the key is essentially parallel to an upper surface of the window.

11. The electronic device of claim 8, wherein a part of the key circuit board is exposed between the support frames, and the key circuit board is a fingerprint recognition flexible printed circuit board (FPCB).

12. The electronic device of claim 8, wherein the bumper extends in a direction opposite to a protruding direction of the support frames.

13. The electronic device of claim 8, wherein the key coupling unit is disposed between the window and the bracket, and configured in a structure of which electric parts of a main circuit board for an electric drive of the electronic device are closed off from the window at a rear surface of the bracket.

14. The electronic device of claim 8, wherein the key coupling unit further comprises:

a pair of support plates disposed at upper and lower parts, respectively, of the key guide frame, and a plurality of waterproofing tapes attached between the support plates.

15. The electronic device of claim 14, wherein the support plates are fixed in the settling area of the bracket and exposed through the opening of the window, and one of the waterproofing tapes is attached between an upper one of the support plates and the key coupling unit, and another one of the waterproofing tapes is attached between a lower one of the support plates and the key coupling unit.

16. The electronic device of claim 8, wherein the window further comprises an additional member which is used as a decoration member.

* * * * *